United States Patent [19]

Hofmann et al.

[11] Patent Number: 4,590,903

[45] Date of Patent: May 27, 1986

[54] FUEL INJECTION APPARATUS FOR DEFINITE PILOT INJECTION AND MAIN INJECTION IN INTERNAL COMBUSTION ENGINES

[75] Inventors: Eberhard Hofmann, Kirchberg/M; Helmut Pfeifle, Recamier Allée; Reinhard Schwartz, Stuttgart; Helmut Tschöeke, Ostfildern, all of Fed. Rep. of Germany

[73] Assignee: Robert Bosch GmbH, Stuttgart, Fed. Rep. of Germany

[21] Appl. No.: 644,086

[22] Filed: Aug. 24, 1984

[30] Foreign Application Priority Data

Aug. 26, 1983 [DE] Fed. Rep. of Germany ..... 3330773
Jul. 11, 1984 [DE] Fed. Rep. of Germany ..... 3425460

[51] Int. Cl.[4] ..... F02M 39/00

[52] U.S. Cl. ..... 123/300; 123/447; 123/575; 239/533.5

[58] Field of Search ..... 123/299, 300, 514, 575, 123/576, 577, 446, 516, 447, 578; 239/533.1–533.12

[56] References Cited

U.S. PATENT DOCUMENTS 2,173,814 9/1939 Bischof ..... 123/300
3,394,891 7/1968 Voit ..... 123/299
3,403,861 10/1968 Eidtmann ..... 239/533.5
4,289,098 9/1981 Norberg ..... 123/300
4,356,976 11/1982 Eblen ..... 239/533.5
4,389,987 6/1983 Frankle ..... 123/300

FOREIGN PATENT DOCUMENTS 1284687 12/1968 Fed. Rep. of Germany ..... 123/300
1914742 10/1970 Fed. Rep. of Germany ..... 123/300
3002851 7/1981 Fed. Rep. of Germany .

*Primary Examiner*—Carl Stuart Miller
*Attorney, Agent, or Firm*—Edwin E. Greigg

[57] ABSTRACT

A fuel injection apparatus for definite pilot and main injection in internal combustion engines. A hydraulic auxiliary pump is supplied via a pressure line with fuel from a high-pressure injection pump, which fuel reaches a main injection nozzle and simultaneously drives the hydraulic auxiliary pump. The hydraulic auxiliary pump contains a differential piston comprising a reservoir piston and a pilot injection piston with different diameters and with a spring prestressing such that between the end of supply of the pilot injection and the onset of supply of the main injection, an injection-free spacing stroke (DH) which can be predetermined by means of mechanical stops results, during which spacing stroke (DH) the reservoir piston by retracting further, receives the supply quantity which is pumped during the injection interval by the high-pressure injection pump.

15 Claims, 9 Drawing Figures

53
30'
41
27'
51
23'
23a'
48
47
45
14'
49
22'
17a'
35
17'
33
40
34
38
37
19'
34a
17'
36
39
22a'
43
56
46
42
44
50
52
VH
VE
DH
FH
VE
55
54
29
29c
23

FUEL INJECTION APPARATUS FOR DEFINITE PILOT INJECTION AND MAIN INJECTION IN INTERNAL COMBUSTION ENGINES

BACKGROUND OF THE INVENTION

The invention is based on a fuel injection apparatus as generally described hereinafter. A known fuel injection apparatus of this kind (German Offenlegungsschrift No. 30 02 851) includes a piston supported in a slidable manner in a bore of an auxiliary pump—although solely for the application in which on the one hand a main fuel that is not readily ignited and is supplied by a high-pressure injection pump and on the other hand an igniting fuel pumped by a separate low-pressure feed pump are to be delivered via the hydraulic auxiliary pump to separate injection nozzles for the main fuel and the igniting fuel in a Diesel engine. The piston is prestressed by a spring (see FIG. 5 of this document) and on one end it is acted upon by the pressure of the high-pressure injection pump, while the remote end of the piston is preceded by a work chamber, to which fuel, in this case the igniting fuel, is delivered from the low-pressure feed pump. The piston has a control groove forming a control edge, and the distance between the control edge and the end of the piston remote from the work chamber determines the pilot injection quantity of the igniting fuel.

However, the overlapping times for the pilot and the main injections may be considered problematical, because there is no possibility of arranging the pilot and main injections in a predetermined chronological sequence, or of establishing a definite storage quantity between the two, because of the positive displacement volume of the piston. It is not even possible to prevent another pilot injection from taking place as the piston continues to slide downward in response to the feed pressure of the main fuel. The desired accurate control of the chronological sequence of the pilot and main injections is also difficult because of the dead volumes existing in the many connecting lines and leads to deviations from the specified course of events, especially as a function of rpm.

An apparatus for pilot injection is also known (German Pat. No. 1 252 001) which has a separate small piston disposed axially parallel to and offset from a load piston for the main injection inside a fuel injection valve. A separate supply of low pressure is not provided in this known apparatus; the pilot injection quantity is derived from the supply of fuel for the main injection. As a result, the standing pressure in the pressure line and thus the accuracy of fuel quantity control is unfavorably affected.

Finally, in a further known apparatus (German Offenlegungsschrift No. 28 34 633) for controlling the pilot injection in internal combustion engines, a one-piece control slide displaceable counter to the force of a spring is provided, which with a pronounced intervening relief into a reservoir establishes the various desired connections for the pilot and the main injection. Here, again, the fuel for the pilot injection is diverted from the supply quantity of the injection pump that also furnishes the main injection quantity, so that once again there is a negative effect on the accuracy of fuel quantity control for the main injection quantity.

OBJECT AND SUMMARY OF THE INVENTION

The fuel injection apparatus according to the invention and having the characteristics revealed herein has the advantage over the prior art that a definite chronological separation between two injections (pilot and main injections) with different and likewise predeterminable quantities can be realized. A lessening of the increase in combustion pressure and a resultant noise reduction are attained thereby, and the combustion can be controlled overall such that the amount of toxic exhaust gases as well as fuel consumption remain low.

The invention makes it possible to provide an interval of several degrees of camshaft angle, as desired, between the supply onset of the pilot injection, or the end of the pilot injection, and the supply onset of the main injection, by means of the appropriate embodiment, positioning, and stroke limitation of the working or reservoir piston acting upon the pilot injection piston, so that the supply quantity continuously furnished by the high-pressure pump can be received, which quantity is delivered during the interval in supply.

Specifically, the invention enables the following:

(1) an adjustable supply onset for the main injection via a change in volume to be performed preceding the reservoir piston;

(2) changing the spacing or interval between the pilot and the main injection by limiting the travel of the reservoir piston;

(3) changing the supply onset of the pilot injection quantity by adjusting the outset position of the pilot injection piston, whereupon (4) the pilot injection quantity that is definable by the position of the control edge on the pilot injection piston remains unchanged.

The characteristics further recited in this application make it possible to attain advantageous modifications of and improvements to the fuel injection apparatus disclosed. A particularly advantageous feature is the embodiment of the pilot injection piston and the reservoir piston as differential pistons of different diameters and with a corresponding step-up. The main and pilot injection nozzle can be combined in a double-needle nozzle holder with the auxiliary pump containing the differential piston. As a result, the dead volumes in the lines become particularly small, and it is necessary to provide only a single spring chamber with a coaxially disposed stepped piston.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
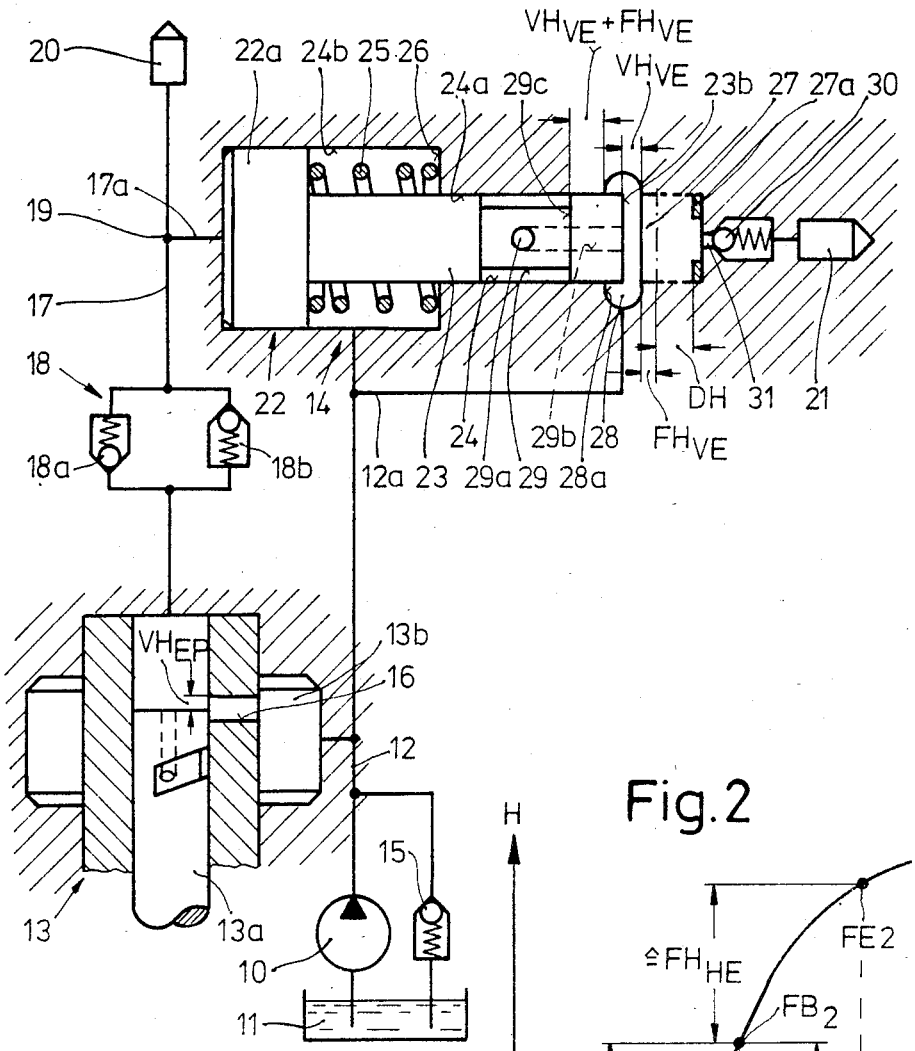
FIG. 1 is a rough schematic illustration of the basic embodiment of an auxiliary pump according to the invention, having associated high-pressure and low-pressure feed pumps in an overall view.

In FIG. 1, 10 identifies a low-pressure pump delivering fuel from a tank or supply container 11 at a prespecified pressure (for instance, 2 bar) via a delivery line 12 to a high-pressure injection pump 13 and to a hydraulic auxiliary pump 14. The delivery line 12 is sealed off from the tank 11 via a pressure regulating valve 15; the high-pressure injection pump 13 may be of a conventional, known type. A camshaft-controlled pump piston 13*a* passes fuel that has flowed to it from a suction chamber 13*b* and a control bore 16, having been pumped by the low-pressure feed pump 10, at high pressure into a pressure line 17, in which two parallel, contrarily operating check valves 18*a*, 18*b* are incorporated, forming a so-called equal pressure relief valve 18. The pressure line 17 leads via a branch indicated at 19 to a main injection nozzle 20 and via the branch line 17*a* to the hydraulic auxiliary pump 14. The hydraulic auxiliary pump 14 is generally designed such that under the high-pressure influence of the main injection quantity it pumps a predetermined, constant pilot injection quantity to a pilot injection nozzle 21. From the highly schematic illustration of the hydraulic auxiliary pump 14 provided in FIG. 1, it can be seen that the hydraulic auxiliary pump 14 has a double piston 22, comprising a first working, reservoir or driving piston 22*a* and a functionally subsequent pilot injection piston 23 which is driven at least indirectly by the first piston 22*a* and slides in the narrowed portion 24*a* of a stepped bore 24 of the hydraulic auxiliary pump 14. In the enlarged portion of the bore 24*b* of the stepped bore as compared with the narrowed portion 24*a*, the reservoir piston 22*a* is supported in a slidable manner and pressed via a prestressing spring 25 into the initial position shown in the drawing. The prestressing spring 25 is supported on the shoulder 26 formed by the step in the bore 24. The diameter of the reservoir piston 22*a* is notably larger than that of the pilot injection piston, in the illustrated exemplary embodiment being twice as large, so that a desired step-up ratio is attained in terms of the injection pressures and in the fuel quantities positively displaced or received at identical units of piston travel.

The stepped bore 24 forms a work chamber 27 disposed before the pilot injection piston 23; this work chamber 27 is acted upon by the pilot injection piston 23 and is supplied with fuel pumped by the low-pressure feed pump 10 via an annular groove 28 and a branch line 12*a* of the delivery line 12. The pilot injection piston 23, which is guided in its bore portion 24*a* in a fluid-tight manner has an annular groove 29, spaced apart by a predetermined distance from the end of the piston, which communicates for instance via a transverse bore 29*a* and a longitudinal piston bore 29*b* with the work chamber 27. The pilot injection fuel quantity positively displaced out of the work chamber 27 after the closure of the annular groove 28 upon a movement of the pilot injection piston 23 toward the right in the plane of the drawing reaches the pilot injection nozzle 21 via a pressure conduit 31 connected to the bore bottom of the work chamber 27 by way of an interposed check valve 30.

Figure 2:
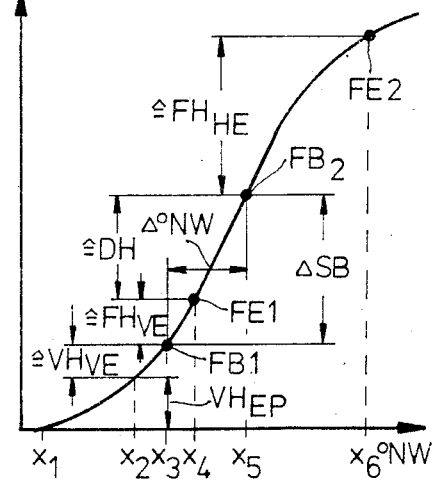
FIG. 2 shows the course of the various strokes and injection events over time in the way in which they are realized by the auxiliary pump according to the invention, plotted in the form of a curve course over the camshaft angle.

Since the pressure step-up ratios and the spring prestressing in the vicinity of the hydraulic auxiliary pump 14 are dimensioned such that when the supply pressure of the high-pressure injection pump 13 is being exerted, the driving or reservoir piston 22*a* initially executes a movement directed toward the pilot injection nozzle 21 and receives fuel quantities pumped accordingly, without the main injection nozzle 20 opening and delivering fuel at high pressure to the combustion chambers or inlet conduits associated with it, the following mode of operation results, as will be explained below referring to the diagram in FIG. 2.

Up to the onset of supply or pumping by the high-pressure injection pump 13, a predetermined period of time at first elapses, dictated by the condition that the supply edge of the pump piston 13*a* must first close the control bore 16. In the diagram of FIG. 2, the reference variables $x_1 \ldots x_6$ shown on the abscissa can be understood to represent degrees of camshaft angle (the symbol for which on the drawing is °NW), or at times corresponding to the course of the cam elevation curve in the diagram; vertically, the stroke H is shown as a unit of travel on the part of the pump piston 13*a*. In the diagram, from $x_1$–$x_2$ first the injection pump pre-stroke $VH_{EP}$ is shown, a distance travelled by the pump piston 13*a* of the high-pressure injection pump 13 up to the effective onset of supply and the corresponding pressure increase in the pressure line 17. Then a further, injection-free stroke movement takes place, which is designated as the pilot injection pre-stroke $VH_{VE}$ and can also be found so designated in FIG. 1. This pre-stroke of the pilot injection corresponds to the duration or the camshaft angle degrees from $x_2$–$x_3$ up to the supply onset FB1 of the pilot injection, at which instant the supply edge of the pilot injection piston 23, formed by the end face 23*b*, has closed the annular conduit 28. Then from $x_3$–$x_4$, the pilot injection supply stroke $FH_{VE}$ takes place, which is ended (pilot injection end of supply FE1) whenever a front annular edge 29*c* of the annular groove 29 on the pilot injection piston 23 reaches the control edge 28*a* of the annular conduit 28 and relieves the work chamber 27 of pressure in favor of the line 12*a*. It will be noted that in this manner, namely by means of the distance between the front annular edge 29*c* on the pilot injection piston 23 with respect to the piston end face 23*b* and the control edge 28*a* of the annular conduit 28 it it possible to determine the pilot injection quantity. In the same manner, the pilot injection pre-stroke $VH_{VE}$ can be adjusted by varying the spacing between the end face 23*b* of the pilot injection piston and the annular conduit 28. The pressure relief of the work chamber 27 determines the end of supply FE1 of the pilot injection at $x_4$ and this is then followed by an overall injection-free spacing stroke DH, the duration of which is determined for instance by the time required for the front end of the piston to strike the bore bottom of the work chamber 27 or a stop 27*a* disposed at that location. It will be understood that other stops, which for instance act directly upon the reservoir piston 22*a* (see stop 56 in FIG. 3), may be provided instead. As soon as the reservoir piston 22*a*, because of the stop means, has ended its displacement movement that takes place under the high pressure of the pumped fuel, the spacing stroke DH is ended, and the hydraulic auxiliary pump 14 receives no further storage quantities of the pumped fuel. The interval in pumping or supply that takes place between the pilot injection and the main injection as a result of the spacing stroke from $x_4$–$x_5$ is ended, and this is then followed by the main injection supply stroke $FH_{HE}$ from $x_5$–$x_6$ in the diagram of FIG. 2, during which the fuel quantity attaining the main injection is determined in a known manner by how the high-pressure injection pump 13 is adjusted with respect to the various engine parameters.

It will be appreciated that the present invention assures a clean and definite separation between the pilot injection and the main injection, with the reservoir piston 22*a* receiving the supply quantity that is pumped during the pumping interval, resulting from the spacing stroke DH, by the high-pressure injection pump 13. By varying the differential piston movement stops determining the spacing stroke DH, the injection onset interval SB between the pilot injection and the main injection can be varied in accordance with °NW from the supply onset of the pilot injection to the supply onset of the main injection. The pilot injection fuel quantity $Q_{VE}$ resulting from the pilot injection pre-stroke $FH_{VE}$ is constant, but likewise definable.

Figures 3, 3A:
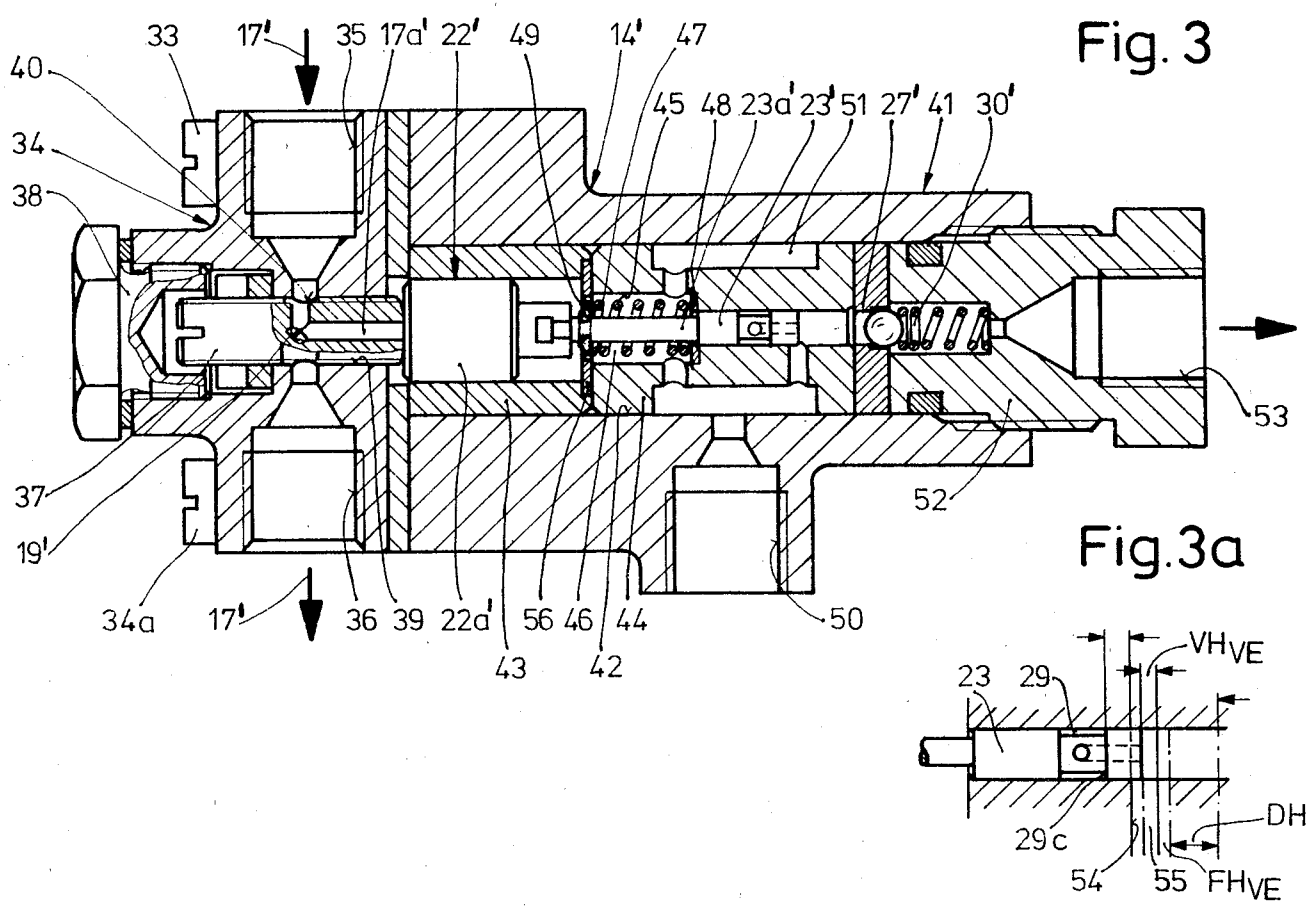
FIG. 3 is a more-detailed view of an auxiliary pump according to the invention, separately for the various injection valves, in box form in a cross section.
FIG. 3*a* is an enlarged fragmentary sectional view of the area of the pilot injection piston control groove.

The exemplary embodiment of the invention shown in FIG. 3 has an auxiliary pump 14' also encompassing the line branch 19' in block form, which if desired may be disposed arbitrarily separately from the nozzle holder for the pilot injection nozzle and/or the main injection nozzle. It will be understood, however, that the auxiliary pump according to the invention may also be a component of one or both nozzles, especially in the case where the main injection nozzle and pilot injection nozzle are combined into a double nozzle (on this, see FIG. 4 with the cross-sectional illustrations in FIGS. 4*a*–4*d*.)

The auxiliary pump 14' represents an embodiment appropriate for actual use and includes an extension 34 flanged on laterally via securing means (screws 33) and responsible primarily for the line branch 19' (corresponding to the branching point 19 in FIG. 1). The inlet opening for the pressure line 17' from the high-pressure injection pump (not shown) is shown at 35, and the outlet leading on toward the main injection nozzle is shown at 36. The line branch is effected here inside an adjusting means, preferably a set screw 37, by means of which, as will be explained below, the instant for the supply onset of the pilot injection can be determined. The set screw 37 is screwed into a thread of a bore 39 of the extension 34 that is closed by a plug 38 that can be screwed onto it, additionally via a longitudinal conduit 17*a'* the set screw 37 carries the fuel pumped by the high-pressure injection pump to the compression side of the working or reservoir piston 22*a'*. In this process, the pumped fuel also travels, via an annular groove 40 in the set screw 37, to the pressure outlet 36 leading to the main injection nozzle. The support of the differential piston 22' can be effected generally by means of a stepped bore in a main body 41 encompassing the hydraulic auxiliary pump 14'. In accordance with the exemplary embodiment shown here, the main body 41, which is connected with the extension 34, has a cylindrical inner bore 42, which receives tubular insert elements which serve to support and guide the differential piston 22' and also serve to form the inlet and discharge conduits.

A first tubular insert element 43 is provided, having a correspondingly large inner bore for slidably receiving the reservoir piston 22*a'* adjacent to the entrance of the longitudinal conduit 17*a'* in the set screw 37 that is delivering fuel at high pressure. Toward the right in the plane of the drawing, this first insert element 43 is adjoined by a second insert element 44, serving to support and guide the pilot injection piston 23', which has a stepped inner bore at 45, which with an enlarged diameter initially forms a spring chamber 46, adjacent to the reservoir piston 22*a'*. A prestressing spring 47 surrounds a piston-rod-like extension 23*a'* of the pilot injection piston 23' and is supported at one end via an interposed spring plate 48 on the shoulder formed by the step of the inner bore 45 and on the other end on a spring plate 49, which are secured on the piston rod 23*a'*. The reservoir piston 22*a'* as a result undergoes a prestressing in the direction of the fuel pumped by the high-pressure injection pump, which also applies to the pilot injection piston 23', which preferably rests by means of the piston rod 23*a'* on the reservoir piston 22*a'* in a positively engaged manner and forms with it a unitary differential piston 22*a'*. Otherwise, the pilot injection piston 23' is embodied in the same way as that described above in connection with FIG. 1. The second insert element 44, via an annular recess 51 communicating with a pressure inlet 50 for fuel pumped by the low-pressure feed pump and corresponding transverse conduits, delivers the fuel, which is at low pressure, to the work chamber 27' located before the pilot injection piston 23' and to the spring chamber 46 (for the purpose of relieving its pressure). The outlet check valve 30' is already located in a closure plug 52 screwed into the bore 42 of the main body 41, which plug also forms the outlet connection 53 leading on to the pilot injection nozzle.

FIG. 3*a* illustrates the relationship between the lengths of the stroke executed under the supply pressure of the high-pressure injection pump by the pilot injection piston 23' of the hydraulic auxiliary pump 14' thus embodied. The distance between a diversion edge 54 of a transverse bore 55 (corresponding to the annular conduit 28 and the diversion rim edge 28*a* of FIG. 1) and the front edge 29*c* of the annular groove 29' on the pilot injection piston 23' indicates the sum of the pilot stroke plus the supply stroke of the pilot injection and is designated, as in FIG. 1, by the symbols $VH_{VE}+FH_{VE}$. The reservoir or storage stroke resulting until the end of the stroke is again represented as the spacing stroke DH. The end of the stroke, in this embodiment, is defined by placing a predetermined number of spacer elements, shims or the like, which are marked 56, between the insert element 43 and the insert element 44. Thus, as a result, the reservoir piston 22*a'* strikes a stop earlier or later, depending on the number of shims used, and this then determines the onset of the supply stroke of the main injection as well.

It will also be seen that the initial position of the differential piston (reservoir piston 22*a'* and pilot injection piston 23') can be predetermined by screwing in the set screw 36 to a greater or lesser depth, thereby determining the instant for the supply onset of the pilot injection. The duration and thus the quantity of the pilot injection are the result, as noted above, of the distance between the front edge 29*c* of the annular groove 29 of the pilot injection piston 23' and the diversion edge 54 of the transverse bore 55 delivering fuel from the low-pressure feed pump. The width of the annular groove 29' of the pilot injection piston 23' should be selected such that during the entire spacing stroke, as determined by corresponding mechanical stops, the work chamber 27' preceding the pilot injection piston 23' remains relieved of pressure, so that no new pilot injection will occur. (This applies in a corresponding manner to the exemplary embodiment of FIG. 1.)

Figures 4, 4A, 4B, 4C, 4D:
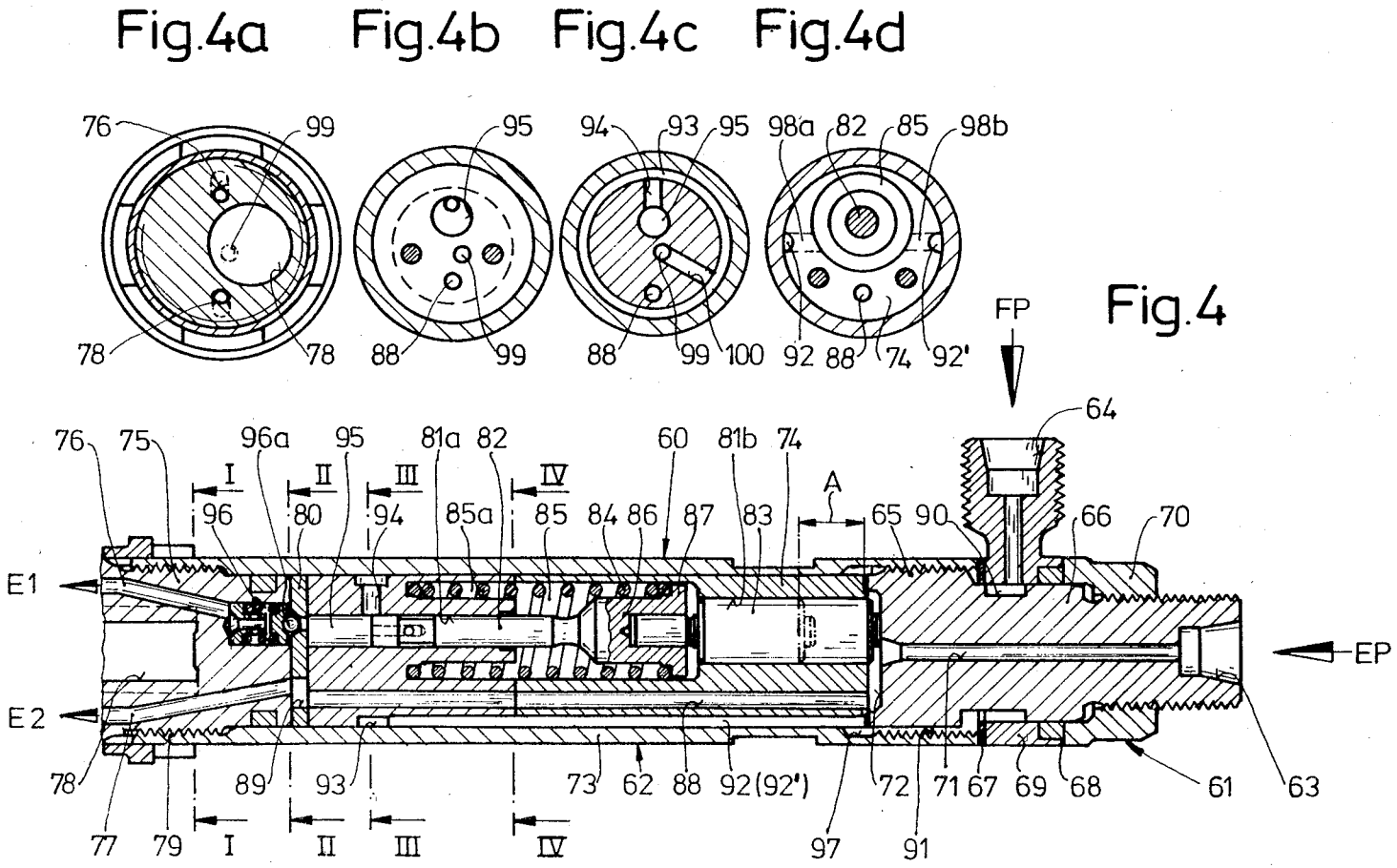
FIG. 4, including
FIGS. 4*a*, 4*b*, 4*c* and 4*d*, shows a further exemplary embodiment of the invention in the form of a double-needle nozzle having an integrated pilot injection piston in longitudinal section and in various cross sections.

FIG. 4 shows one exemplary embodiment in which the auxiliary pump for pilot injection is integrated in one embodiment of a double-needle nozzle holder. The injection valve 60 shown in FIG. 4 and having a double-needle nozzle and an integrated pilot injection auxiliary pump is shown in cross sectional views as follows: in FIG. 4*a*, taken along the line I—I, in FIG. 4*b*, taken along the line II—II; in FIG. 4*c*, taken along the line III—III; and in FIG. 4*d*, taken along the line IV—IV of the injection valve 60. The injection valve 60 includes a connection piece 61, which is connected with an intermediate piece 62 of the auxiliary pump and has a pressure line connection 63 to the high-pressure injection pump as well as a low-pressure connection 64 which is connected with the low-pressure feed pump. In detail, the connection piece 61 comprises an inner, cylindrical insert 66 with stepped outside diameters and is screwed into the intermediate piece 62 at 65. With the interposition of suitable seals 67, 68, an annular element 69 having the low-pressure connection 64 is then fitted onto the insert 66, being held by means of a sleeve nut 70 screwed onto the insert 66. A pressure conduit 71 for the fuel which is at high pressure passes through the insert 66 substantially centrally, beginning at the line connection 63, and discharges into a recess in the insert 66 which forms a fuel pressure distributing chamber 72.

The intermediate piece 62 adjoining the connection piece 61 is embodied by a bracing-tube-like hollow cylinder 73, which in an internal thread receives the insert 66 of the connection piece 61, as has just been noted, and in its interior it contains an auxiliary pump insert element 74. A nozzle holder 75, shown only in part in FIG. 4, and having both the pressure conduit 76 for the pilot injection fuel, which is at low pressure, and the pressure conduit 77 for the fuel at high pressure as well as the spring chamber shown only schematically at 78 is fitted onto the other end of the hollow cylinder 73. In the exemplary embodiment, the nozzle holder 75 is screwed into an internal thread of the supporting hollow cylinder 73, as indicated at 79, and thus also, via an interposed sealing intermediate element 80 which extends the pressure conduits, keeps the auxiliary pump insert element 73 in contact with the insert 66 of the connection piece 61. The insert element 74 is embodied in two parts.

The auxiliary pump device is disposed eccentrically, away from the middle, of the auxiliary pump insert element 64 and substantially includes a stepped bore 81*a*, 81*b*, the first bore 81*a* slidably supporting a pilot injection piston 82 for the pilot injection and the second bore 81*b* slidably supporting a working or reservoir piston 83. The reservoir piston 83 is under the high fuel pressure of the high-pressure injection pump that results in the recess 72 of the insert 66 and transmits its action to the pilot injection piston 82 with a corresponding step-up. The two pistons 82 and 83 of the pilot injection pump may be embodied in one piece or as separate parts fitting one inside the other; they move in common, in response to the action of what in the illustrated exemplary embodiment is merely a single prestressing spring 84 by way of example, which is disposed in a spring chamber 85 which is continued toward the bottom as an annular bore 85*a*, thereby surrounding the bearing bore 81*a* for the pilot injection piston 82. In this manner a relatively large number of spring windings can be freely selected, so that the spring characteristic can be designed in whatever manner is desired.

The connection area between the pilot injection piston 82 and the reservoir piston 83, which is generally marked 86 in FIG. 4, may be embodied in an intrinsically arbitrary manner, and in any case forms a spring plate rest 87, on which the prestressing spring 84 is supported, resting on its other end in the bore bottom of the annular bore 85*a*.

The delivery of fuel for the pilot injection and the main injection elapses as follows. The fuel which is under the high pressure of the main injection travels from the high-pressure connection 63 via the pressure conduit 71 already mentioned to the recess 72 and then travels through a rectilinear pressure conduit 88, which is disposed eccentrically in the auxiliary pump insert element 74, and on via an opening 89 in the intermediate element 80 to the pressure conduit 77 in the nozzle holder 75 and from there continues on to the main injection nozzle, which is an area marked E2 in the drawing.

The fuel for the pilot injection travels from the low-pressure connection 64 to a first annular conduit 90 in the insert 66, which naturally may also be embodied by the annular part 79, and from there via "external" conduits 91 in or on the insert 66 and 92 in or on the insert element 74 in the auxiliary pump area, as far as a second annular conduit 93, which communicates via a transverse conduit 94 with a work chamber 95 preceding the pilot injection piston 82. By the positive displacement of fuel out of the work chamber 95, the pilot injection fuel travels via a check valve 96, here provided with a ball 96*a*, to the pressure conduit 76, carrying fuel at low pressure to the pilot injection, in the nozzle holder 75 and from there to the pilot injection area E1.

The conduits 91; 92, 92' carrying the fuel at low pressure for the auxiliary pump pilot injection are called "external" conduits because in the preferred form of embodiment shown in FIG. 4 they are embodied as external longitudinal grooves in the inserts 66, 74, and the grooves attain the form of conduits by being surrounded or encompassed by the hollow cylinder 73. In general, virtually all the conduits, bores, and reservoir, pressure and work chambers extend in such a way that oblique bores are avoided, thereby assuring manufacture at a favorable cost and with relatively little effort, because a further substantial advantage of the integrated double nozzle system is that leak-off return bores and receiving chambers can be dispensed with entirely, and the leak-off is fed back to the pilot injection internally via the low-pressure system. Only the two outer line connections 63 and 64 are therefore required, so that while the same radial outer dimensions are retained, the pilot injection auxiliary pump can be disposed inside the double nozzle holder and can generally be compact in structure at little effort. It should also be noted in connection with FIG. 4 that the groove carrying the conduit 92 for the pilot injection fuel is shown offset by 90°, as shown by the cross-sectional views of FIGS. 4*a*–4*d*, which will be described in further detail below. The grooves 92 and additionally 92' discharge into a third intermediate annular chamber, which is formed at 97 at the transition from the insert 66 to the insert 74.

The advantageous combination of the leak-off guidance with the low-pressure system of the pilot injection will be best understood from the cross sectional views of FIGS. 4*a*–4*d*. As shown in FIG. 4*d*, two lateral grooves 92, 92' are provided diametrically opposite one another, beginning at the third annular chamber 97 in the auxiliary pump insert element 74, these grooves 92, 92' communicating with the spring chamber 85 for the auxiliary pump stepped piston via transverse bores 98*a*, 98*b*.

The section located further toward the bottom of FIG. 4*d*, corresponding to FIG. 4*c*, shows the transverse bore 94 leading out of the annular chamber 93 to the work chamber 95, as well as a further axial conduit 99, which can begin at this level and communicates via a transverse conduit 100 with the annular chamber 93. This axial conduit 99 serves to guide leakage fuel out of the spring chamber 78 of the nozzle holder 75, where it is shown again, identified by the same reference numeral. It will be appreciated that by means of this single additional leak-off conduit 99 and a few transverse bores, a complete recirculation of leakage fuel, integrated into the low-pressure system for the pilot injection, is attained, and the two outer line connections may be disposed on the same connection piece 61, leading away therefrom axially and radially, respectively.

The exemplary embodiment of a combination injection valve, containing an integrated pilot injection auxiliary pump and as shown in FIG. 4, assures the same adjustment possibilities as those explained in detail above in connection with FIG. 2; in other words, corresponding adJustments of both intervals and quantities can be attained, the stroke length traveled by the working or reservoir piston 83 being indicated by A. The mode of operation in the area of the auxiliary pump is similar to what has been described above. The stroke ends whenever the front end of the pilot injection piston 82 strikes the bore bottom of the work chamber 95, or in this case the intermediate element 80; on the other hand, the end of the pilot injection, as already explained above, is the result of the action of the diversion edge embodied by the transverse bore 94. The remainder of the stroke then traversed by the reservoir piston 83 is the free spacing stroke lasting until the main injection begins.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection apparatus for pilot and main injection in internal combustion engines (Diesel engines), comprising a main injection nozzle supplied with a main injection quantity by a high-pressure injection piston via a pressure line having a hydraulic auxiliary pump connected thereto, said hydraulic auxiliary pump contains a reservoir piston, driven by the supply pressure of said high-pressure injection piston, said auxiliary pump further including a pilot injection piston including an annular groove having a frontal control edge for dimensioning the pilot injection nozzle quantity and said pilot injection piston including an end control edge relative to a work chamber, said frontal control edge of said annular groove being spaced from said end control edge to control the end of preinjection by relieving said work chamber and said end control edge controls a beginning of the preinjection stroke by closing said work chamber, a low-pressure fuel feed pump which delivers fuel for the pilot injection to said work chamber, said reservoir piston being embodied to drive said pilot injection piston at least indirectly, said pilot injection piston having a diameter that is less than that of said reservoir piston and constructed and arranged so that a spacing stroke (DH) of the reservoir piston which is free of injections, is predeterminable by said annular groove and by stop means and thereby receives an adjustable storage quantity of fuel within the spacing stroke (DH) and between the end of supply (FE1) of said pilot injection (VE) and the supply onset (FB2) of said main injection.

2. A fuel injection apparatus for pilot and main injection in internal combustion engines (Diesel engines), comprising a main injection nozzle supplied with a main injection quantity by a high-pressure injection piston via a pressure line, said pressure line having a hydraulic auxiliary pump connected thereto, said hydraulic auxiliary pump contains a differential piston driven by the supply pressure of said high-pressure injection piston, said auxiliary pump further including means embodied by an annular groove for dimensioning the pilot injection nozzle quantity, said apparatus further having a low-pressure fuel feed pump which delivers fuel for the pilot injection to a work chamber, said differential piston includes a reservoir piston and a pilot injection piston driven by said reservoir piston, said pilot injection piston having a diameter that is less than that of said reservoir piston and constructed and arranged so that a spacing stroke (DH) of the reservoir piston which is free of injections, is predeterminable by said annular groove and by stop means and thereby the auxiliary pump receives an adjustable storage quantity of fuel thereby between the end of supply (FE1) of said pilot injection (VE) and the supply onset (FB2) of said main injection, said pressure line includes a pressure line branch ahead of said reservoir piston arranged to communicate with said differential piston, a prestressing spring arranged to act upon said differential piston and said reservoir piston and pilot injection piston of said differential piston further having step-up ratios which are designed so that up to the supply onset (FB2) of the main injection and within the spacing stroke (DH) of said differential piston predetermined by mechanical stop means, the fuel quantities pumped by said high-pressure injection pump are exclusively received by said hydraulic auxiliary pump.

3. A fuel injection apparatus as defined by claim 1, further wherein said supply onset (FB2) and an end of a spacing stroke (DH) of said main injection are determined by a stop for at least said pilot injection piston in an associated piston guide.

4. A fuel injection apparatus as defined by claim 1, further wherein said supply onset (FB2) and an end of a spacing stroke (DH) of said main injection are determined by a stop for at least said reservoir piston in an associated piston guide.

5. A fuel injection apparatus as defined by claim 2, further wherein said main and pilot injection nozzles are combined as a double injection nozzle, and said hydraulic auxiliary pump together with said pressure line branch is secured as a block to a nozzle holder.

6. A fuel injection apparatus as defined by claim 2, further wherein said apparatus further includes a main body having a bore said bore arranged to receive plural insert elements having different inner bores for receiving said differential piston and further that said I main body is provided with an extension means arranged to receive said pressure line branch.

7. A fuel injection apparatus as defined by claim 6, further wherein said extension means includes a set screw which is arranged to strike said reservoir piston and thereby determine the initial position of said differential piston and simultaneously delivers the fuel pumped by said high-pressure injection pump to said reservoir piston, via a central longitudinal conduit means which communicates with said main injection nozzle by means of an annular conduit.

8. A fuel injection apparatus as defined by claim 6, further wherein said main body is further provided with a closure plug having a check valve and an outlet connection which leads to said pilot injection nozzle said main body forming a separate functional block together with said extension means which receives said line branch.

9. A fuel injection apparatus as defined by claim 7, further wherein said main body is further provided with a closure plug having a check valve and an outlet connection which leads to said pilot injection nozzle, said main body forming a separate functional block together with said extension means which receives said line branch.

10. A fuel injection apparatus as defined by claim 1, further wherein said apparatus further includes a double nozzle needle holder and interconnected means comprising said auxiliary pump for said pilot injection as well as pressure lines said apparatus further arranged to retain the radial outer dimensions of the adjacent component parts.

11. A fuel injection apparatus as defined by claim 10, further wherein said interconnected means enclose low-pressure and high-pressure lines, low- and high-pressure conduits and low- and high-pressure chambers whereby leakage fuel is arranged to be introduced into a low-pressure pilot injection line provided in said apparatus.

12. A fuel injection apparatus as defined by claim 10, further wherein at least one of said interconnected means forms slide-bearing guides for said reservoir piston and said pilot injection piston in an eccentric, stepped inner bore, said inner bore having a chamber arranged to receive a spring, a prestressing spring in said chamber and said spring arranged to act as the restoring spring for both said pilot injection piston and said reservoir piston.

13. A fuel injection apparatus as defined by claim 11, further wherein at least one of said interconnected means forms slide-bearing guides for said reservoir piston and said pilot injection piston in an eccentric, stepped inner bore, said inner bore having a chamber arranged to receive a spring, a prestressing spring in said chamber and said spring arranged to act as the restoring spring for both said pilot injection piston and said reservoir piston.

14. A fuel injection apparatus as defined by claim 10 further wherein said interconnected means comprise a housing for at least said pilot injection pressure conduits embodied as external grooves which communicate via transverse conduits with said spring chamber for said auxiliary pump piston and at least indirectly with a spring chamber of said double nozzle needle holder to provide leak-off recirculation.

15. A fuel injection apparatus as defined by claim 11 further wherein said interconnected means comprise a housing for at least said pilot injection pressure conduits embodied as external grooves which communicate via transverse conduits with said spring chamber for said auxiliary pump piston and at least indirectly with a spring chamber of said double nozzle needle holder to provide leak-off recirculation.

* * * * *